US007338336B2

(12) United States Patent
Loui et al.

(10) Patent No.: US 7,338,336 B2
(45) Date of Patent: Mar. 4, 2008

(54) WATERCRAFT HULL WITH ADJUSTABLE KEEL

(75) Inventors: Steven Loui, Honolulu, HI (US); Scott Yamashita, Honolulu, HI (US); Gary Shimozono, Kapolei, HI (US)

(73) Assignee: Navatek, Ltd., Honolulu, HI (US)

( * ) Notice: Subject to any disclaimer, the term of this patent is extended or adjusted under 35 U.S.C. 154(b) by 34 days.

(21) Appl. No.: 11/294,472

(22) Filed: Dec. 6, 2005

(65) Prior Publication Data

US 2006/0137591 A1 Jun. 29, 2006

Related U.S. Application Data

(60) Provisional application No. 60/639,463, filed on Dec. 27, 2004.

(51) Int. Cl.
*B63H 5/16* (2006.01)

(52) U.S. Cl. ..... 440/69

(58) Field of Classification Search ..... 440/68–70, 440/38, 47, 46; 114/138–141
See application file for complete search history.

(56) References Cited

U.S. PATENT DOCUMENTS

| | | | | |
|---|---|---|---|---|
| 352,682 | A * | 11/1886 | Edmondson | 114/129 |
| 1,265,035 | A | 5/1918 | Bazaine | |
| 1,665,149 | A | 4/1928 | Van Wienen | |
| 2,753,135 | A | 7/1956 | Gouge | 244/106 |
| 3,146,752 | A | 9/1964 | Ford | 114/67 |
| 3,308,780 | A | 3/1967 | Abramson | 114/66.5 |
| 3,456,611 | A | 7/1969 | Johnson | 114/66.5 |
| 3,528,380 | A | 9/1970 | Yost | 114/66.5 |
| 3,561,389 | A | 2/1971 | Hunt | 114/66.5 |
| 3,998,176 | A | 12/1976 | Stout et al. | 114/283 |
| 4,371,350 | A | 2/1983 | Kruppa et al. | 440/69 |
| 4,406,635 | A | 9/1983 | Wuhrer | 440/69 |
| RE31,563 | E | 4/1984 | Stout et al. | 114/283 |
| 4,649,847 | A | 3/1987 | Tinkler et al. | 114/39 |
| 4,682,560 | A | 7/1987 | Lieb et al. | 114/343 |
| 4,756,265 | A | 7/1988 | Lane | 114/57 |
| 4,821,663 | A | 4/1989 | Schad | 114/43 |
| 4,977,845 | A | 12/1990 | Rundquist | 114/289 |
| 5,588,389 | A | 12/1996 | Carter, Jr. | 114/271 |
| 6,193,573 | B1 | 2/2001 | Small | 440/69 |
| 6,461,206 | B2 | 10/2002 | Small et al. | 440/69 |
| 6,544,081 | B1 | 4/2003 | Paulo | 440/69 |
| 6,773,316 | B1 | 8/2004 | Keehn, Jr | 440/68 |
| 2004/0142609 | A1 | 7/2004 | Davis | 440/12.51 |

FOREIGN PATENT DOCUMENTS

| | | | |
|---|---|---|---|
| DE | 3607942 | * | 9/1987 |
| WO | WO87/00135 | * | 1/1987 |

* cited by examiner

*Primary Examiner*—Ed Swinehart
(74) *Attorney, Agent, or Firm*—Fitzpatrick, Cella, Harper & Scinto

(57) ABSTRACT

A watercraft hull having a pair of laterally spaced propulsion tunnels located on opposite sides of its keel, with said tunnels being open downwardly towards the water, includes a movably mounted keel section located between said propulsion tunnels to prevent water crossflow between said tunnels and increase dynamic lift on the hull.

16 Claims, 8 Drawing Sheets

WATERCRAFT HULL WITH ADJUSTABLE KEEL

This application claims the benefit of U.S. Provisional Application No. 60/639,463, filed Dec. 27, 2004.

SUMMARY OF THE INVENTION

The present invention relates to watercraft hulls and more in particular to a boat hull having recessed ventilating propulsion tunnels formed therein.

BACKGROUND OF THE INVENTION

Field of the Invention

Watercraft speed efficiency is achieved by reducing craft drag and improving the efficiency of the propulsion system. The result is higher speeds for the same amount of power used or less power needed to achieve the same speed.

One prior art technology previously developed to accomplish these goals is surface propellers operating in ventilating propulsion tunnels formed in the watercraft hull.

It has been found that the use of surface propellers in ventilating propulsion tunnels improves the control of water flow to the propeller and thereby improves propulsive efficiency. The use of propulsion tunnels in this way also reduces the hull and appendage wetted area, thereby reducing drag. In addition, on the other hand, propulsion tunnels reduce the amount of the buoyant and dynamic lift of the hull.

Another problem with the use of ventilating propulsion tunnels is that in certain operating conditions severe cross flows of water can enter the tunnels reducing the presence of "clean" water at the prop, thereby reducing prop efficiency.

It is an object of the present invention to prevent cross flow of water into the propeller tunnels, thereby to improve propeller efficiency.

It is another object of the present invention to increase dynamic lift in hulls having ventilating propulsion tunnels.

It is a further object of the invention to reduce wetted surface area and drag in hulls having ventilating propulsion tunnels.

Yet another object of the invention is to provide dynamic lift to a hull replacing buoyant lift lost by the presence of ventilating tunnels, while minimizing trimming moments on the hull.

BRIEF DESCRIPTION OF THE INVENTION

In accordance with an aspect of the present invention, a watercraft hull is provided with a pair of ventilating propulsion tunnels in the aft portion of the hull on opposite sides of the keel. The hull bottom or keel portion between the propulsion tunnels, from the transom to approximately the longitudinal center of gravity (LCG) of the hull, is movably mounted to create a deeper draft than the keel line in front of it at the LCG. In one embodiment, side plates (vertical to the free surface) are attached to the hull on opposite sides of the movable hull section between the tunnels to trap divergent hull flows off the keel. In another embodiment the plates are attached to the movable hull section. At the leading edge of movable hull section, also referred to herein as the bent keel, the angular momentum of the water flow along the hull bottom is changed, creating a lifting force. By being close to the LCG, lift is generated without a large lifting moment so that watercraft immersion is reduced without adverse change in watercraft trim.

As a result of the use of the movable bent keel between the propulsion tunnels the hull or vessel obtains an increased lift to drag ratio (L/D) at speed, making the hull more efficient. It also provides a fence or barrier to keep cross-flows from entering the prop tunnels, provides passive roll stabilization at rest and directional roll and yaw stabilization at speed.

In addition the bent keel segment and the side plates provide a grounding keel to protect the props and the rest of hull from grounding damage.

The adjustable bent keel (ABK) of the present invention prevents severe crossflows of water into the propeller tunnels thereby keeping the props efficient and in "clean" water. This action is aided by the use of the depending side plates. The addition of the 4" sideplates helps concentrate the higher pressure produced by the ABK and helps straighten the flows more than the ABK alone. Besides energizing the ABK, if the 4" sideplates do not produce any severe drag penalty, their effect as bilge keels and grounding plates for the props merits their addition to the boat without the ABK deflected. Moreover, deflecting the ABK increases dynamic hull lift.

BRIEF DESCRIPTION OF THE DRAWINGS

The above, and other objects, features and advantages of the present invention will become apparent in the following detailed description thereof, which is to be read in connection with accompanying drawings wherein.

DETAILED DESCRIPTION OF THE PREFERRED EMBODIMENTS

Figure 1:
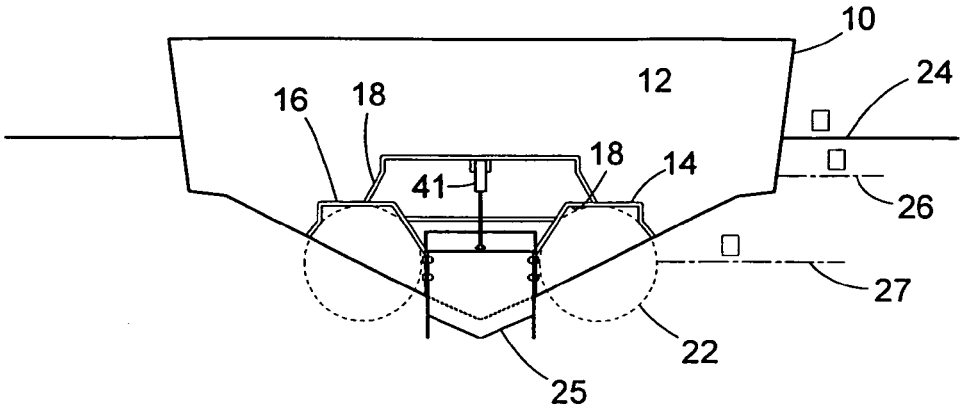
FIG. 1 is a rear elevational view of a boat hull including an adjustable bent keel in accordance with the present invention.
Figure 1A:
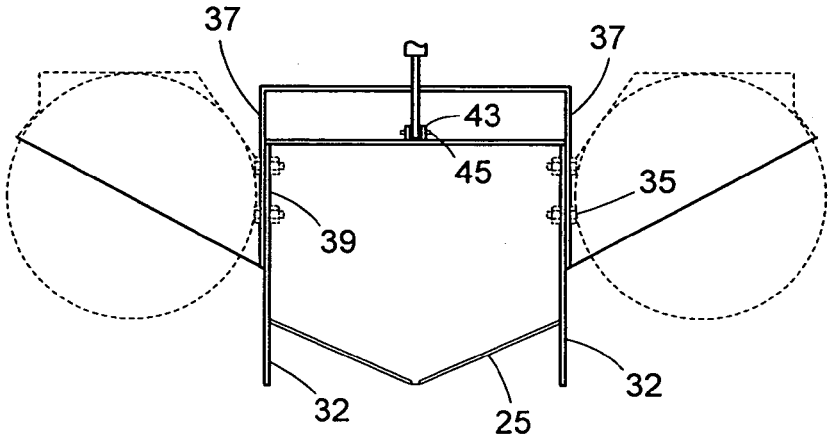
FIG. 1A is an enlarged view of the ABK portion of FIG. 1 showing the ABK in its extended position.
Figure 2A:
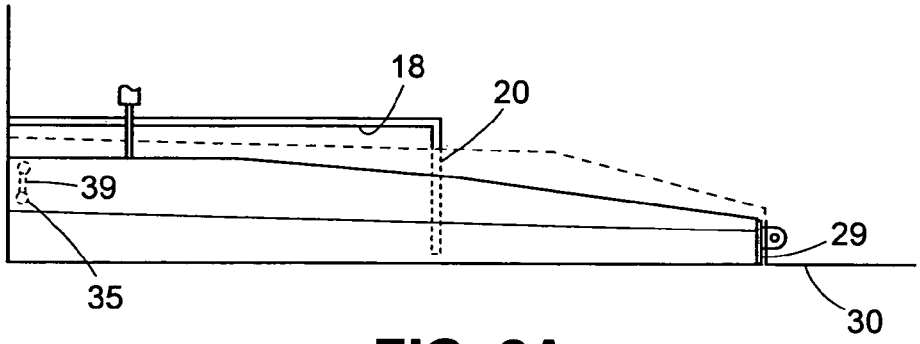
FIG. 2A is a schematic side view of the aft section of the hull shown in FIG. 1 showing the side view of the ABK.
Figure 2B:
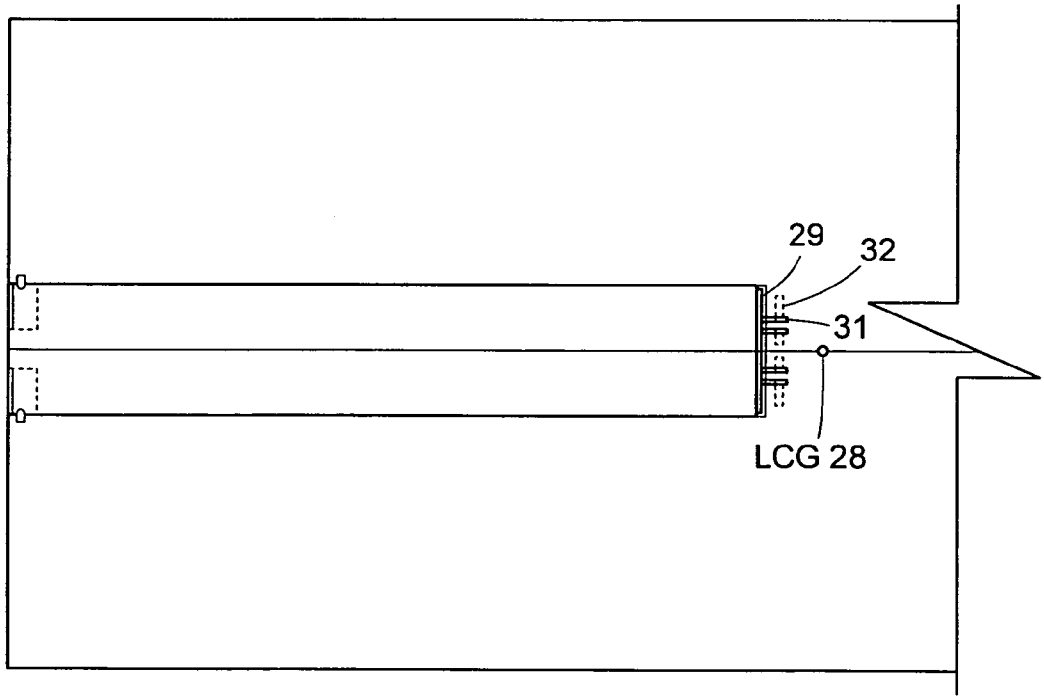
FIG. 2B is a schematic bottom view of the hull showing the pivotal attachment of the ABK to the hull.

Referring now to the drawings in detail, and initially to FIG. 1, a boat hull 10 is illustrated which includes a rear transom 12 and a pair of spaced ventilating tunnels 14, 16 on opposite sides of the centerline of the hull. The ventilating tunnels per se are of generally conventional construction and have an upper wall 18 which either tapers downwardly and forwardly toward the keel line 20 of the hull or are relatively horizontal, and terminates in either a slight taper as seen in dotted lines in FIG. 2A, or abruptly in a vertical wall 2, also shown in phantom lines in FIG. 2A. These propulsion tunnels accommodate a propeller shaft (not shown) and a propeller whose approximate circumference of rotation is indicated by the dotted lines 22 in FIG. 1. As seen therein, the propellers are partially enclosed within the tunnels and partially extended beyond the bottom of the hull. In the at rest position, the hull sits in the water line indicated by the line 24 in FIG. 1. As the hull commences operation, the natural lift created by its forward momentum will raise the hull out of the water to the water line 26. At higher speeds, particularly with the adjustable bent keel described hereinafter extended, additional lift is created on the boat to raise the hull further out of the water as indicated by the water line 27. In this condition, the tunnels are ventilated and the props are functioning as surface props with approximately half their diameter submerged. Of course, the hull is provided with a rudder in the conventional manner aft of the propellers.

In accordance with the present invention, hull 10 is provided with an adjustable hull/keel segment 25 which is pivotally mounted on the hull at its forward end 29 at or slightly aft of the longitudinal center of gravity 28 of the hull. The adjustable bent keel 25, as seen in FIG. 1, is shaped so that in its retracted position, shown in dotted lines in FIG. 1, and also in FIG. 2A, it aligns with the balance of the boat's hull to provide a continuous keel between the tunnels at the same keel line 30 located substantially at the longitudinal center of gravity of the boat.

The adjustable bent keel is pivotally mounted on hull 12 by one or more pairs of pivot ears 31 on its end 29 which receive a pivot pin 33 in any known or convenient manner. The range of pivotal motion of the ABK is controlled by one or more bolts 35 mounted on the inner side walls 37 of the tunnels which are received in arcuate slots 39 formed in opposite sides of the ABK. The ABK is actuated to be deflected in any convenient manner, such as for example by the use of one or more hydraulic rams 41 extending from the hull and connected in any convenient manner to the adjustable bent keel, for example by a pair of pivot ears 43 and a pin 45.

The ABK may be provided with sideplates 32 which extend down from the bottom of the ABK's outer sides near the inner edges of the tunnels.

Figure 1B:
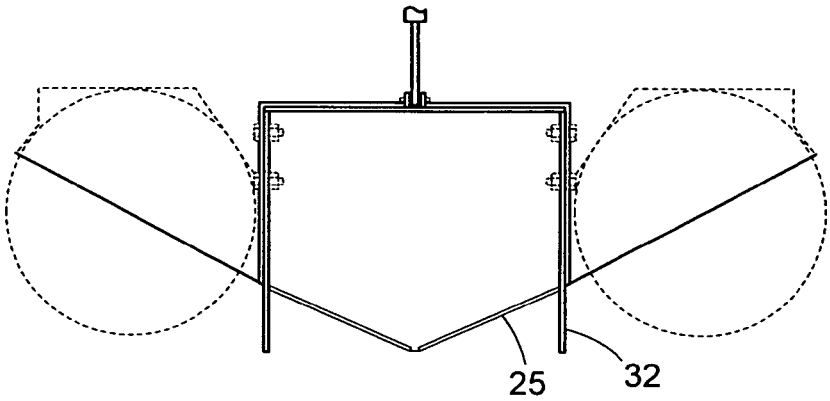
FIG. 1B is a view similar to FIG. 1A showing the ABK retracted.

As described hereinafter, the sideplates help in directing the flow beneath the keel between the tunnels. These plates are useful even without the adjustable feature of the keel being active, to serve as grounding protectors, as seen in FIG. 1B. Indeed, they would be useful as grounding protectors and flow control elements between dual ventilating tunnels even without the ABK.

The ABK may be deflected between the tunnels to any desired extent, preferably between 2 and 4 degrees, to vary and adjust the dynamic lift applied to the vessel.

Applicant has conducted computer based studies with respect to both hulls having ventilated propulsion tunnels and an adjustable bent keel and/or sideplates according to the present invention in order to confirm their effectiveness. Computer models were made using known CFX software at a hull trim of 4 degrees over a speed range of 20 to 45 knots and heaved to a lift of 16 long tons (it). The model looked at the effect of deflecting a 13 foot long portion of the aft center section of the hull, 25, between the ventilating propulsion tunnels with and without 4 inch sideplates. These computer test models were configured as a bare hull, without appendages, with 4 inch sideplates and no adjustable bent keel deflection, with a 3 degree adjustable bent keel deflection and no sideplates, and finally, with a 3 degree adjustable bent keel deflection and 4 inch sideplates.

A second set of computer runs were conducted with hull modeled at a 5 degree hull trim, with no adjustable bent keel deflection and with and without 4 inch sideplates, to serve as a check for the drag imposed by the sideplates themselves.

A third set of computer runs were made with the bent keel deflected 3 degrees and with or without sideplates, and hull trims of 5 and 6 degrees. These were conducted to investigate the trimming moment and drag of the boat at those conditions.

Figure 3:
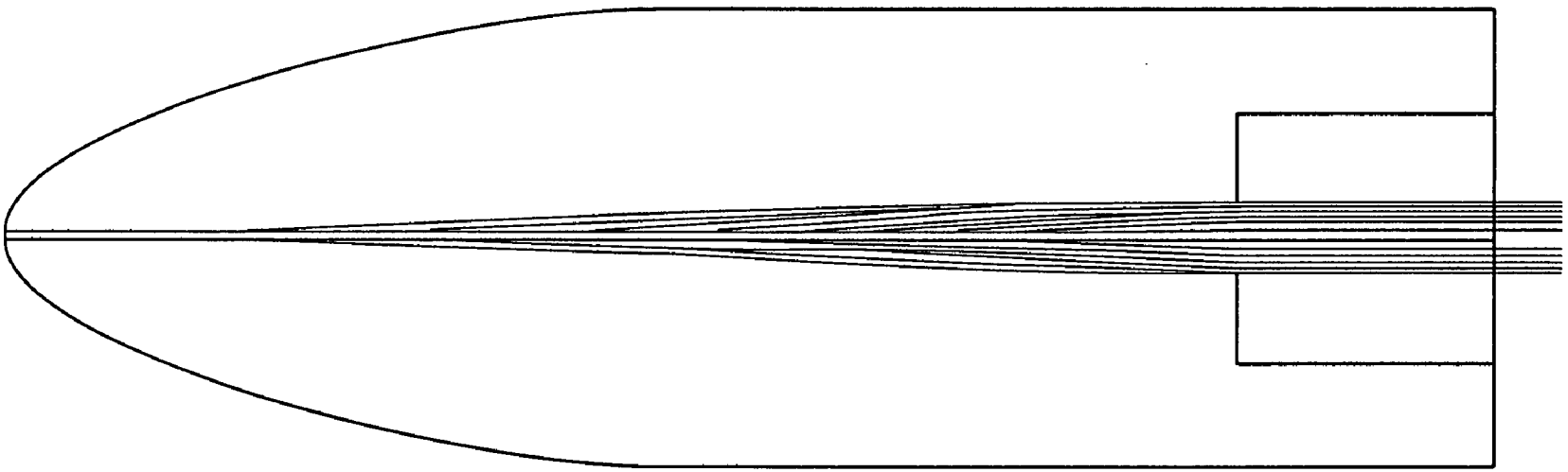
FIG. 3 is another bottom view of the hull shown in FIG. 1 including schematic representation of water flow lines over the adjustable bent keel and between the sideplates.

FIG. 3 shows a bottom view of the hull investigated, and demonstrates the function of the 4 inch sideplates which constrain the flow flowing off of and diverging from the keel into a parallel path between the inside edges of the tunnel. Thus the sideplates prevent cross flows into the power vent tunnels keeping the props efficient and in clean water. As noted above, even in the absence of the adjustment of the bent keel, the sideplates provide grounding protection.

Figure 4:
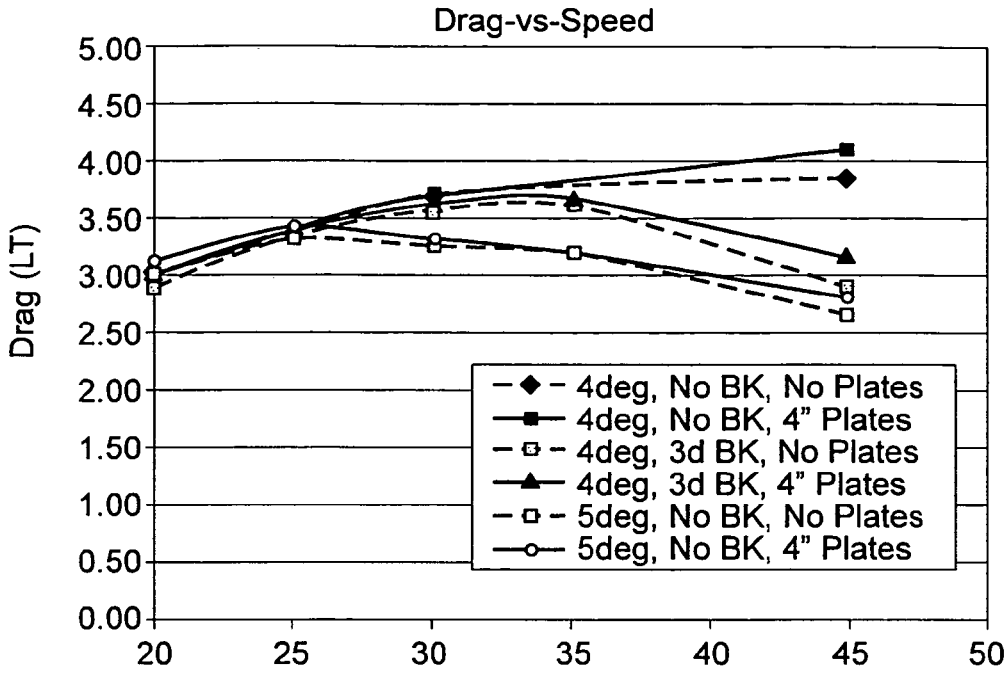
FIG. 4 is a chart demonstrating the effects of the adjustable bent keel and drag at speed of the hull of FIG. 1 as compared to the same hull with no bent keel and no sideplates or with a bent a keel and sideplates, as well as at various trim angles.

FIG. 4 is a chart demonstrating the effect of drag versus speed on each of the conditions listed in the chart. As seen therein, in general there is only small increase in drag produced by the sideplates. At speeds below 35 knots, the increase is so small that it is within the error limits of the software code itself. At 45 knots there appears to be a small drag penalty for the sideplates, but this would be expected at these higher speeds. The increase in drag appeared to be very consistent throughout the speed range for hulls trimmed at either 4 or 5 degrees, with or without the ABK deflected. These results suggest that the overall drag values are reasonable.

The chart of FIG. 4 also demonstrates that the deflection of the keel segment 25 generates more hull pressure or lift at its inflection point. At speeds above 35 knots the adjustable bent keel generates more lift along its entire length which heaves the boat, unwets the hull and reduces total drag.

While the chart demonstrates that a 5 degree hull trim without an adjustable bent keel had the least drag, throughout the speed range, this suggests that running the ship at a trim of 5 degrees with an adjustable bent keel will also be more efficient than the same hull without the keel.

Figure 5:
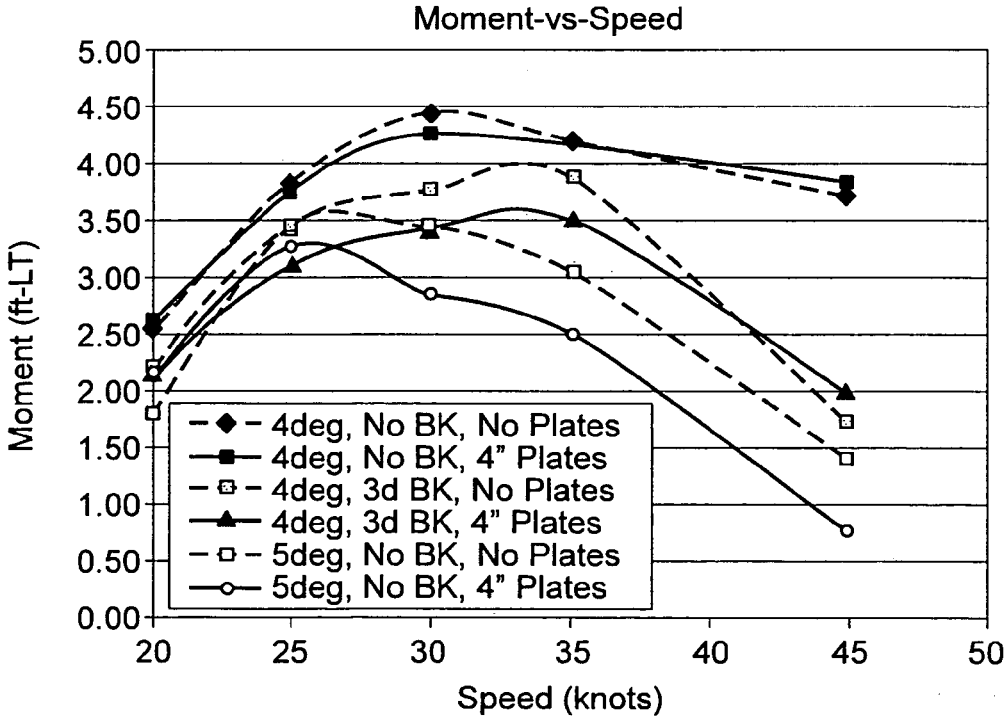
FIG. 5 is a chart similar to FIG. 4 showing the effects of trim moment versus speed for the various conditions shown in FIG. 4.

As will be apparent, the higher pressure of the adjustable bent keel is aft of the longitudinal center of gravity of the hull and therefore reduces the bow up moment of the hull as speed is increased. This is demonstrated in the chart of FIG. 5.

Applicant has also noted that the higher pressure generated at the inflection point of the adjustable bent keel appears to dampen out turbulent water seas which may tend to form along the sideplates and produce crossbows from the center of the hull to the prop tunnels.

Figure 6:
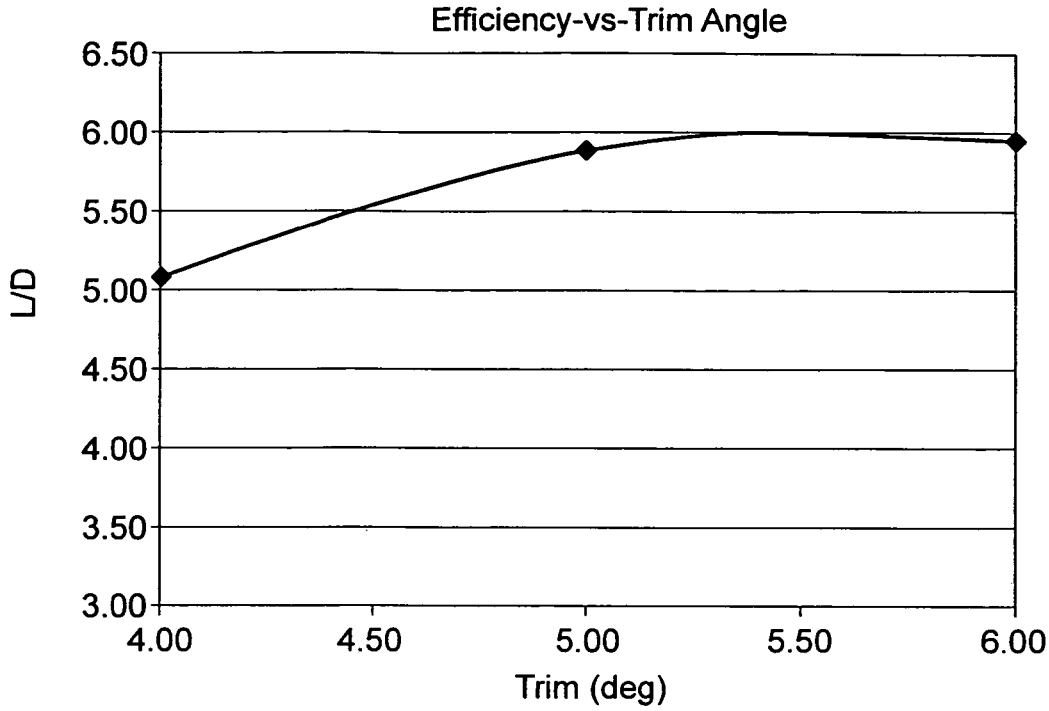
FIG. 6 is a chart showing the effects on the lift to drag ratio of a ship versus trim angle for an adjustable bent keel which is deflected at a 3 degree angle.
Figure 7:
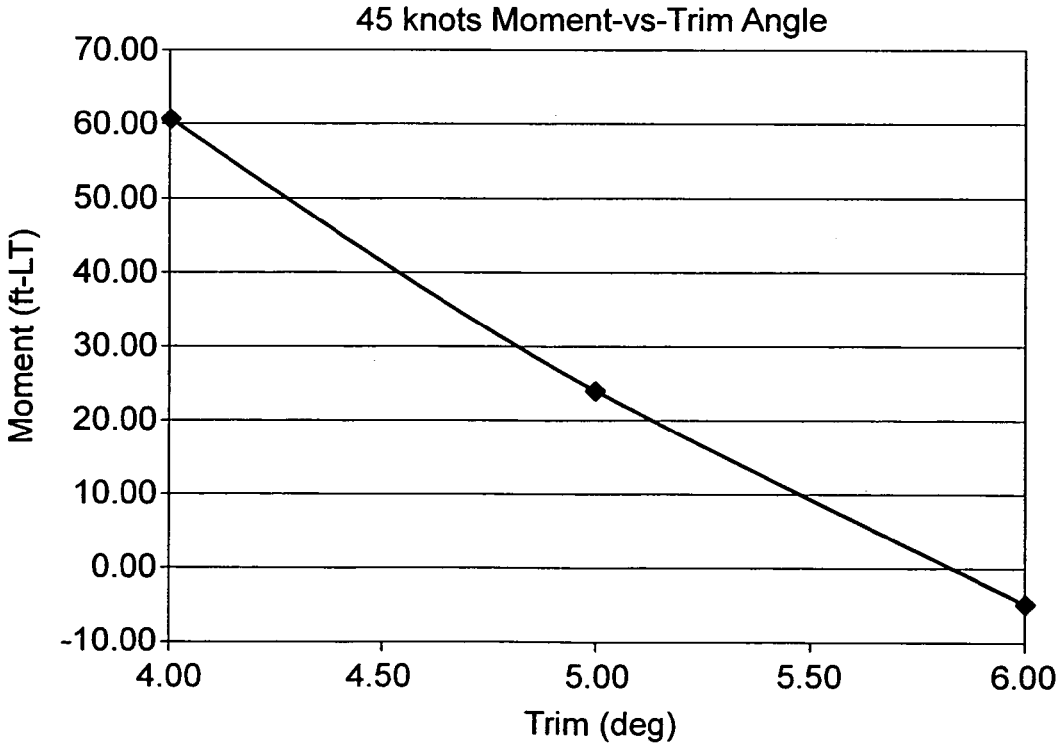
FIG. 7 is a chart showing the effects on the trim moment versus angle of trim for the same vessel having a bent keel deflected at 3 degrees and four inch sideplates.

While the chart of FIG. 4 also indicates that at 45 knots the hull has less drag with a trim of 5 degrees than 4 degrees, the balance of the tests at a trim of 6 degrees did not result in any less drag than the 5 degree trim. This indicates that the optimum trim for the hull should be somewhere 5 and 6 degrees at 45 knots. Based on the trimming moments, the hull should trim in the area of about 5.8 degrees at 45 knots. This is demonstrated by the charts of FIGS. 6 and 7. It is seen that the trim is substantially the same on the vessel operating at 45 knots whether it is set at 5 degrees or 6 degrees.

FIGS. 8-11 demonstrate the pressure distribution on the hull in the various conditions tested. The stippled areas on the hull represent increasing pressure forces on the hull with increasing stippling.

Figure 8:
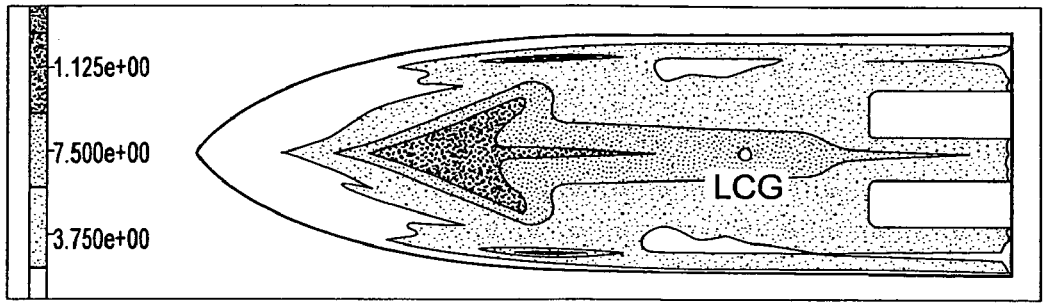
FIG. 8 is a pressure diagram shown against the bottom of the hull having a pair of ventilating propulsion tunnels operating at 30 knots and a trim of 4 degrees.

In FIG. 8, the pressure distribution on the hull trimmed at 4 degrees and moving at 30 knots is illustrated.

Figure 9:
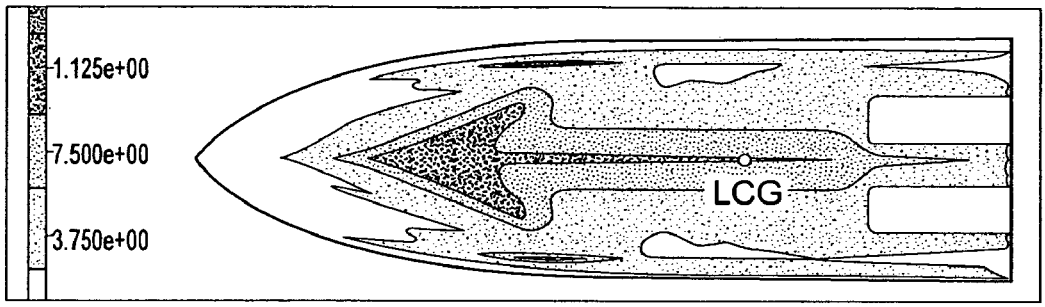
FIG. 9 is a pressure graph for the same hull using 4 inch sideplates extending from the hull on opposites of the keel along the inner sides of the tunnels.

FIG. 9 illustrates the pressure distributions on the same hull under the same conditions with only the 4 inch sideplates extending rearwardly from slightly behind the longitudinal center of gravity. As seen therein, there are some scattered pressure gradients adjacent the sideplates.

Figure 10:
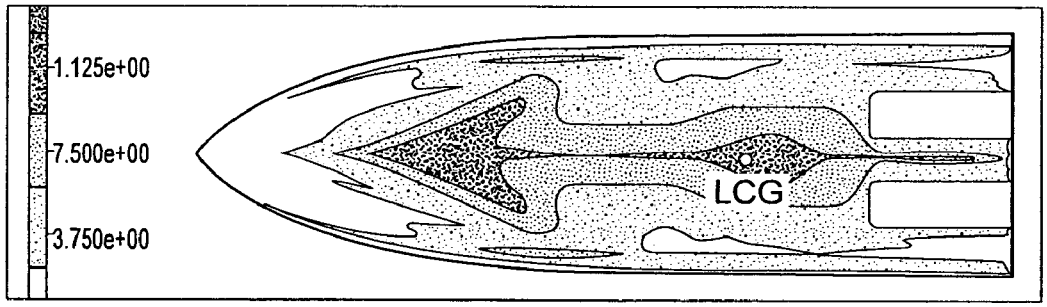
FIG. 10 is a pressure diagram similar to FIGS. 8 and 9 for the same hull having an adjustable bent keel in accordance with the present invention deflected at 3 degrees with no sideplates.

FIG. 10 shows the pressure distribution on the hull with the keel deflected at 3 degrees and no sideplates. As is apparent, the pressures at the bow are less due to the hull starting to heave up from the lift of the adjustable bent keel, with the noted increase in pressure just aft of the LCG.

Figure 11:
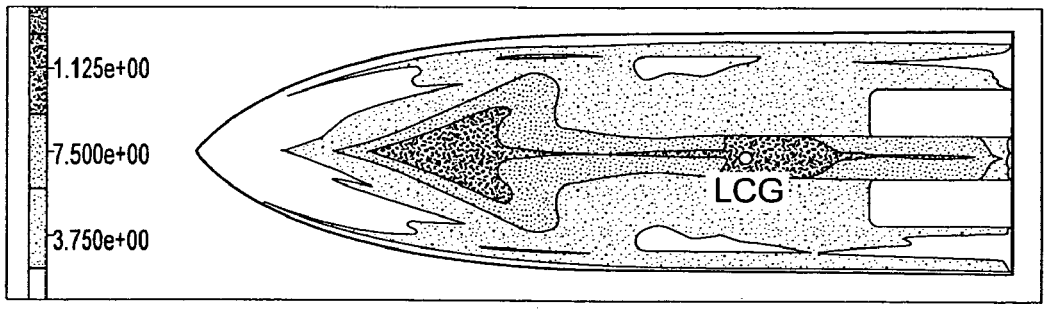
FIG. 11 is a pressure diagram similar to FIG. 10 of the same hull operating under the same conditions with the bent hull deflected 3 degrees and 4 inch sideplates.

FIG. 11 illustrates the pressure distribution on the same vessel with the keel deflected 3 degrees and with 4 inch sideplates. As seen therein, with the sideplates there is no scattered pressures when the bent keel is deflected due to dampening of the vortices from the high pressure of the adjustable bent keel deflection point. The high pressure caused by the bent keel is contained within the sideplates and extends further rearwardly, adding to the lift.

FIGS. 12-15 are similar to FIGS. 8-11, but show the pressure distribution on the hull trimmed at 4 degrees and traveling at 45 knots. Here again the stippled areas represent different pressure gradients, with the heavier stippling representing higher pressure.

Figure 12:
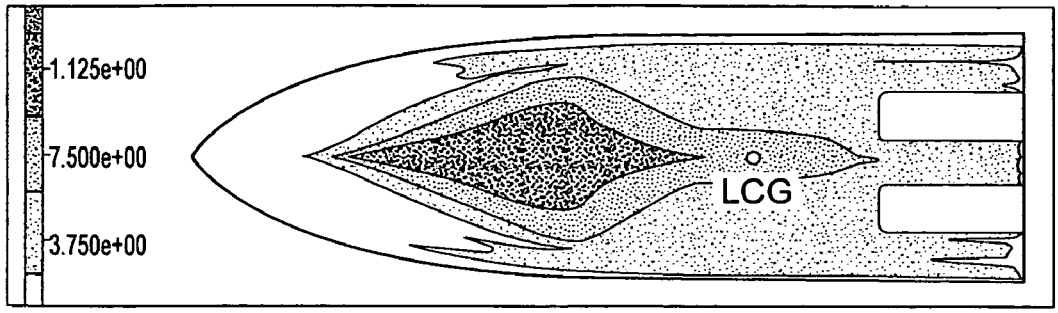
FIG. 12 is a pressure diagram showing pressure distribution on a hull having a pair of ventilating propulsion tunnels trimmed at 4 degrees and operating at 45 knots.

FIG. 12 shows the pressure distribution on the bare hull with no sideplates.

Figure 13:
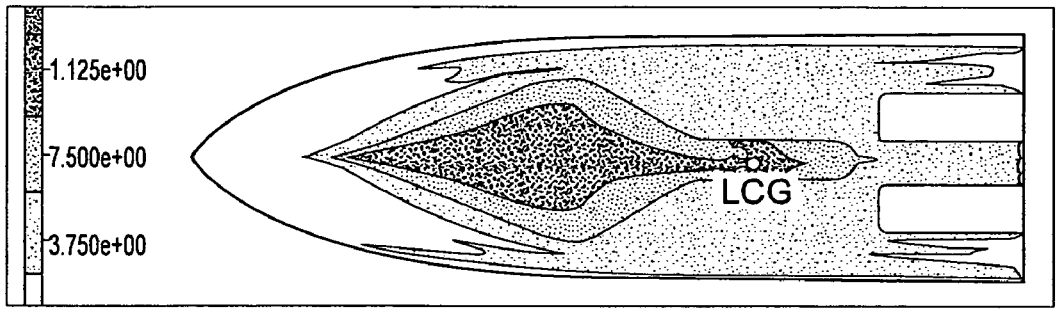
FIG. 13 is a pressure diagram of the same hull using 4 inch sideplates adjacent the inner walls of the tunnels.

FIG. 13 shows the pressure distribution on the hull with 4 inch sideplates extending from near the longitudinal center of gravity of the hull rearwardly adjacent the inner edges of the tunnels. As can be seen in the Figure, there are scattered pressures at their highest magnitude at the plates.

Figure 14:
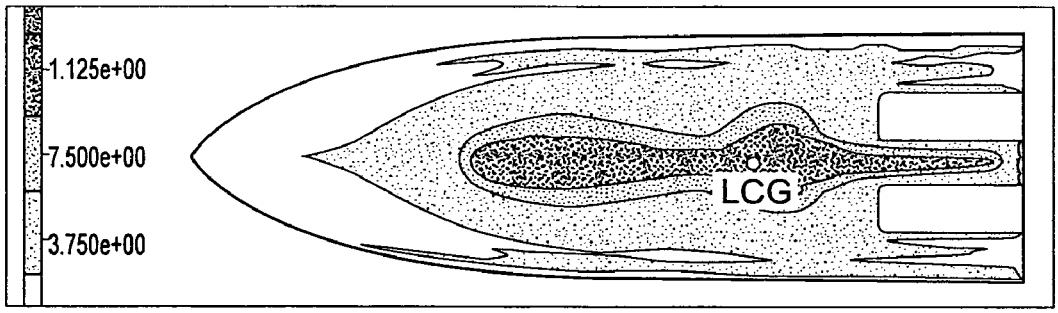
FIG. 14 is a pressure diagram similar to FIG. 13 of the same hull operating under the same conditions but with an adjustable bent keel deflected at 3 degrees and no sideplates.

FIG. 14 illustrates the pressure distribution with the bent keel deflected 3 degrees and no sideplates. As seen therein, there is less pressure on the bow of the boat, and a more even distribution of high pressures along the length of the boat particularly aft of the LCG.

Figure 15:
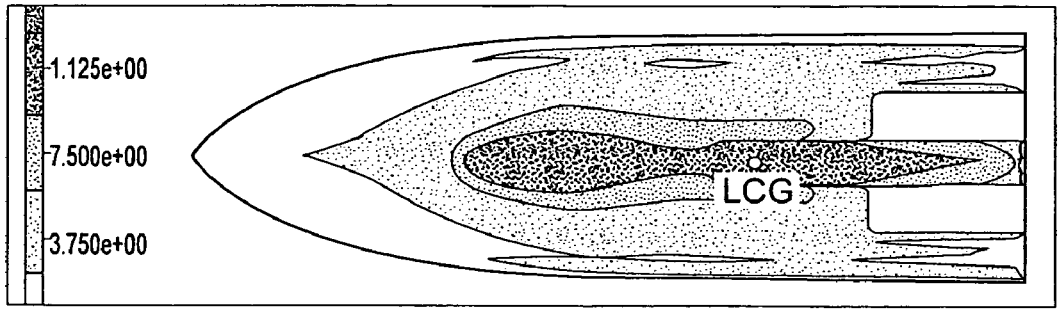
FIG. 15 is a pressure diagram of the same hull show in FIG. 14, with the adjustable bent keel deflected at 3 degrees and with 4 inch sideplates adjacent the inner sides of the tunnels.

FIG. 15 is similar to FIG. 14, but shows the operation of the boat with the bent keel deflected 3 degrees and with the 4 inch sideplates. The bow up moment forward of the LCG is reduced by almost 50%, and the high pressure area on the keel is increased aft of the LCG. Again the creation of vortices in the water adjacent the sideplates is greatly reduced by the presence of the high pressure dampening caused by the adjustable bent keel. This result was unexpected.

Figure 16:
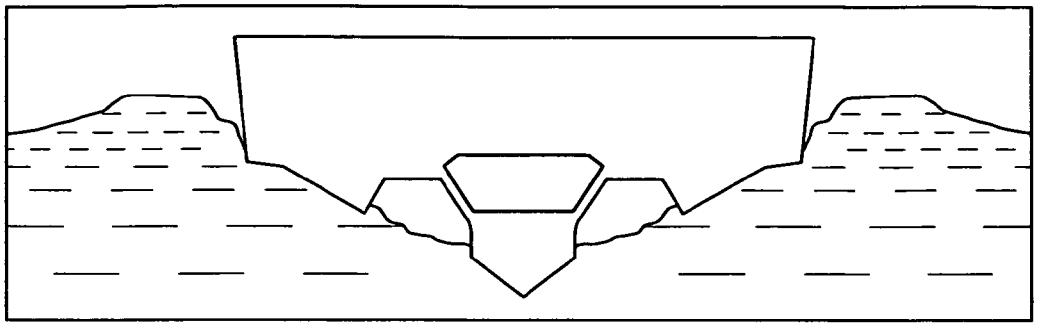
FIG. 16 is a diagrammatic sectional view at the prop of the hull shown in FIG. 12 showing the surface of the water in this condition.
Figure 17:
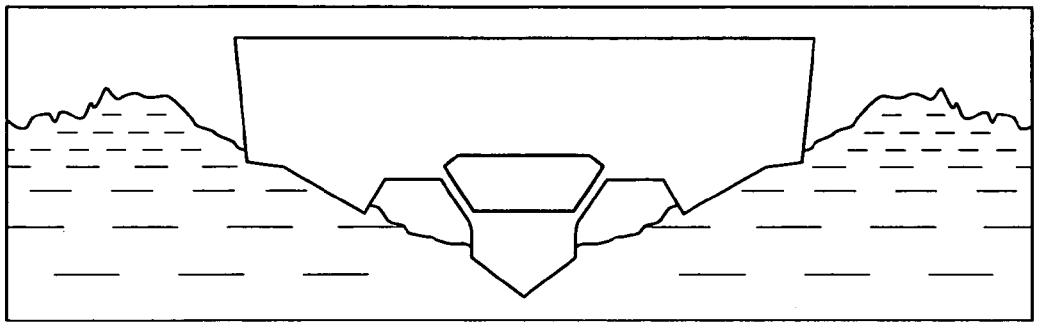
FIG. 17 is a schematic sectional view similar to FIG. 16 of the hull shown in FIG. 13.
Figure 18:
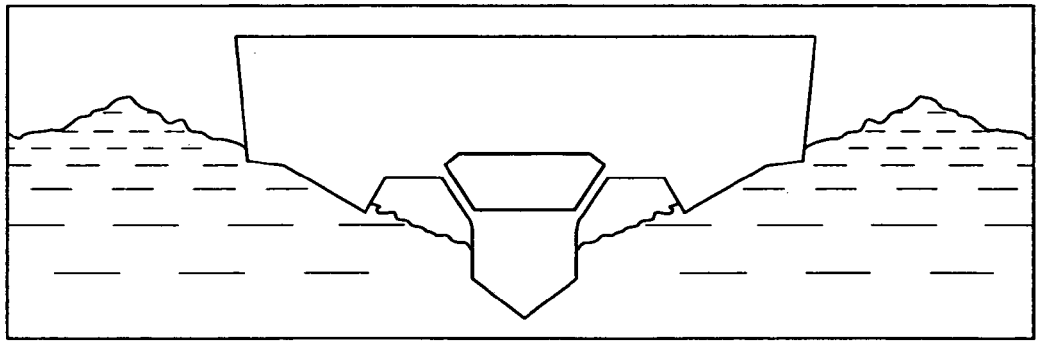
FIG. 18 is a schematic sectional view of the hull shown in FIG. 14.

FIGS. 16-18 are free surface profiles at the prop station (i.e., at the cross-section of the hull located at the prop) showing the ventilating tunnels and the water surface under some of the varying conditions discussed above.

FIG. 16 shows the water conditions on the bare hull with no sideplates. The free surface of the water in the tunnels appears to be fairly even.

FIG. 17 is a similar view of the bare hull but with 4 inch sideplates. As seen therein there is not a substantial change in the free surface as compared to the bare hull condition.

FIG. 18 shows the same hull with the bent keel deflected 3 degrees and no sideplates. There is an apparent slight improvement of the free surface of the water within the tunnels.

Figure 19:
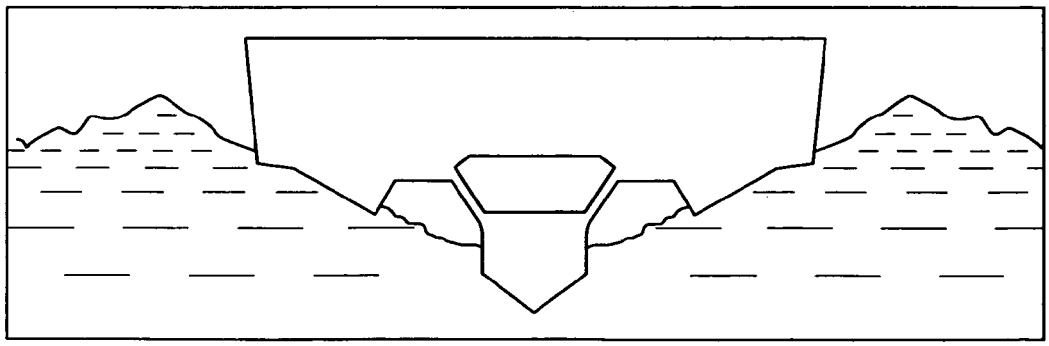
FIG. 19 is a schematic sectional view of the hull in FIG. 15.

FIG. 19 is again a similar view with the bent keel deflected 3 degrees and 4 inch sideplates. The free surface in this view appears to be more even than in any of the other conditions. In both the bent keel deflected with no sideplates and the bent keel deflected with sideplates condition, smaller or no vortices are produced on the inner edge of the tunnels, providing a cleaner free surface area for the props to operate in.

Although illustrative embodiments of the present invention have been described here with reference to the accompanying drawings, it is to be understood that the invention is not limited to those precise embodiments, and that various and modifications made be effected therein without departing from the scope or spirit of this invention.

What is claimed is:

1. A watercraft comprising a hull including a keel and a pair of laterally spaced ventilating propulsion tunnels located on opposite sides of said keel with said tunnels being open downwardly towards the water, and respectively having propulsion propellers located therein; and a keel section located between said propulsion tunnels and having a width substantially equal to the spacing between said tunnels and being movably mounted on said hull to be deflected downwardly into the water to prevent crossflow of water between said tunnels and defining a planing surface to increase dynamic lift on the hull when it is deflected downwardly into the water.

2. A watercraft as defined in claim 1 wherein said movably mounted keel section is mounted to be angularly deflected relative to the keel line of the watercraft with its deeper penetration into the water near the transom of the watercraft.

3. A watercraft as defined in claim 2 wherein said movably mounted keel section is pivotally mounted on the hull at a point aft of the LCG of the hull.

4. A watercraft as defined in claim 3 including means for pivoting that movably mounted keel section between a retracted position and a plurality of angularly deflected positions.

5. A watercraft as defined in any one of claims 2, 3, or 4 including a pair of side plates extending downwardly from said hull adjacent said movably mounted keel section and the inner edges of the tunnels.

6. A watercraft as defined in claim 5 wherein said side plates extend from a point near the LCG of the hull to the transom.

7. A watercraft as defined in any one of claims 2, 3 or 4 including a pair of side plates secured to said movably mounted keel section and extending downwardly therefrom adjacent the inner edges of the tunnels.

8. A watercraft as defined in claim 7 wherein said side plates extend from a point near the LCG of the hull to the transom.

9. A watercraft comprising a hull including a keel and a pair of laterally spaced ventilating propulsion tunnels located on opposite sides of said keel with said tunnels being open downwardly towards the water, and a keel section located between said propulsion tunnels and movably mounted on said hull to be deflected downwardly into the water to prevent crossflow of water between said tunnels and increase dynamic lift on the hull;

said movably mounted keel section being mounted to be angularly deflected relative to the keel line of the watercraft with its deeper penetration into the water being near the transom of the watercraft; and a pair of side plates secured to said movably mounted keel section and extending downwardly therefrom adjacent the inner edges of the tunnels.

10. A watercraft comprising a hull including a keel and a pair of laterally spaced ventilating propulsion tunnels located on opposite sides of said keel with said tunnels being open downwardly towards the water, and a keel section located between said propulsion tunnels and movably mounted on said hull to be deflected downwardly into the water to prevent crossflow of water between said tunnels and increase dynamic lift on the hull;

said movably mounted keel section being mounted to be angularly deflected relative to the keel line of the watercraft with its deeper penetration into the water being near the transom of the watercraft;

said movably mounted keel section being pivotally mounted on the hull at a point aft of the LCG of the hull; and a pair of side plates secured to said movably mounted keel section and extending downwardly therefrom adjacent the inner edges of the tunnels.

11. A watercraft as defined in claim 10 including means for pivoting the movably mounted keel section between a retracted position and a plurality of angularly deflected positions.

12. A watercraft as defined in any one of claims 9, 10, or 11 wherein said side plates extend from a point near the LCG of the hull to the transom.

13. A watercraft comprising a hull including a keel and a pair of laterally spaced ventilating propulsion tunnels located on opposite sides of said keel with said tunnels being open downwardly towards the water, and a keel section located between said propulsion tunnels and movably mounted on said hull to be deflected downwardly into the water to prevent crossflow of water between said tunnels and increase dynamic lift on the hull;

said movably mounted keel section being mounted to be angularly deflected relative to the keel line of the watercraft with its deeper penetration into the water near the transom of the watercraft; and a pair of side plates extending downwardly from the said hull adjacent said movably mounted keel section and the inner edges of the tunnels.

14. A watercraft comprising a hull including a keel and a pair of laterally spaced ventilating propulsion tunnels located on opposite sides of said keel with said tunnels being open downwardly towards the water, and a keel section located between said propulsion tunnels and movably mounted on said hull to be deflected downwardly into the water to prevent crossflow of water between said tunnels and increase dynamic lift on the hull;

said movably mounted keel section being mounted to be angularly deflected relative to the keel line of the watercraft with its deeper penetration into the water being near the transom of the watercraft;

said movably mounted keel section being pivotally mounted on the hull at a point aft of the LCG of the hull; and a pair of side plates extending downwardly from said hull adjacent said movably mounted keel section and the inner edges of the tunnels.

15. A watercraft as defined in claim 13 including means for pivoting the movably mounted keel section between a retracted position and a plurality of angularly deflected positions.

16. A watercraft as defined in any one of claims 13, 14, or 15 wherein said side plates extend from a point near the LCG of the hull to the transom.

* * * * *